United States Patent [19]

Bous

[11] 3,942,315

[45] Mar. 9, 1976

[54] TREATMENT OF TEXTILE FIBRE PRODUCTS

[76] Inventor: Karl Bous, Sternstrasse 74, 56 Wuppertal 2, Germany

[22] Filed: Sept. 26, 1973

[21] Appl. No.: 400,954

[30] Foreign Application Priority Data

Sept. 29, 1972 Germany ..... 2247810

[52] U.S. Cl. ..... 57/164; 8/151; 57/35; 68/19; 118/56; 118/427

[51] Int. Cl.[2] ..... D01H 13/30

[58] Field of Search ..... 8/149, 149.1, 151, 151.1, 8/151.2, 154–155; 68/7–8, 23, 26, 150, 189, 198, 175, 43, 208, 19, 28, 19.1, 19.2; 118/50, 52, 420, 427; 57/35, 164

[56] References Cited

UNITED STATES PATENTS

| | | | |
|---|---|---|---|
| 1,174,995 | 3/1916 | Kremer | 118/427 |
| 1,734,737 | 11/1929 | Martindell | 118/52 |
| 2,320,956 | 6/1943 | Turcotte | 68/202 |
| 2,953,007 | 9/1960 | Drtina | 8/155 |

*Primary Examiner*—Harvey C. Hornsby
*Assistant Examiner*—Philip R. Coe
*Attorney, Agent, or Firm*—Neuman, Williams, Anderson & Olson

[57] ABSTRACT

A method is provided for treating textile goods in which a treating agent such as a dye or washing agent is forced through the goods by simultaneously with the treatment partially centrifuging the treating agent from the goods.

10 Claims, 7 Drawing Figures

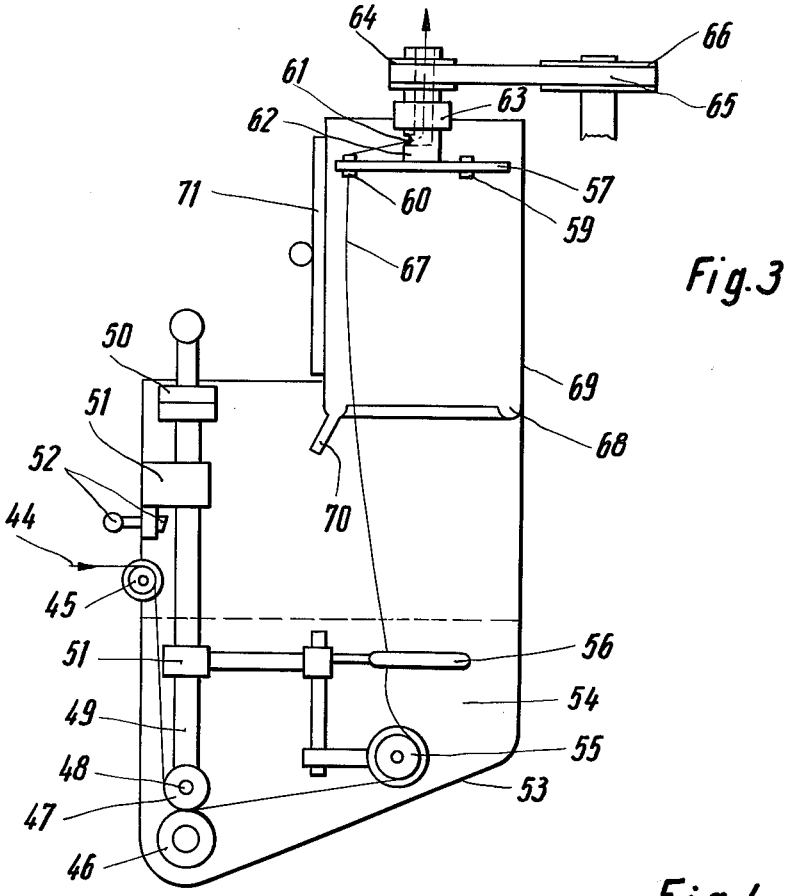
Fig.3
Fig.4
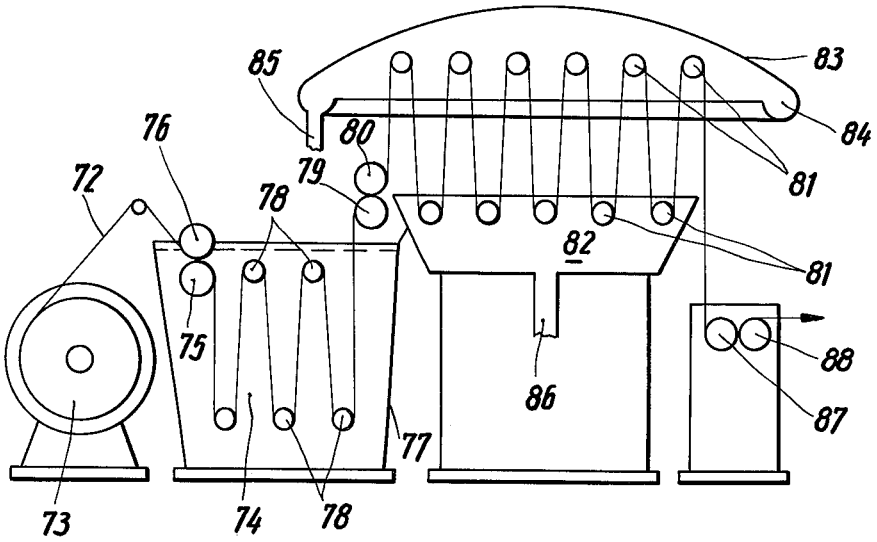

TREATMENT OF TEXTILE FIBRE PRODUCTS

The invention relates to a method and an apparatus for the dyeing, washing, winding or other treatment of textile fibre products, such as yarns, threads, ribbons or tapes.

Devices are already known for applying dye liquors to fibre products or yarn skeins by means of rollers pressed against one another and also devices for the applying of dye liquors by means of nozzles through which the yarn is led together with the dye liquor. The application of dye liquors or any other form of treating fluid to yarns by mutually-pressing rollers can only take place relatively slowly however, since the effective application time available is only very short. The improved method, in which the yarn is passed through a nozzle together with the dye liquor and if required through a connected tube, provides for higher operating speeds, but does not always ensure a uniform application of the dye material, particularly from one operating location to another. At times too great a residue of dye liquor or washing liquor material remains on the fibre product, which impairs the efficiency of the accompanying fixing and/or drying chamber.

An object of the invention is to provide a method for applying a fluid treating agent such as a dye, a treating or a washing liquor material to a moving impregnatable fibre band in a treating zone. The treatment includes forming the band into a loop by rotating the same about an axis extending from the treating zone whereby centrifugal forces are imparted to such band. The band portion disposed in the treating zone is thus intensively impregnated with the treating agent while the loop portion having the greatest centrifugal forces imparted thereto is disposed exteriorly of said zone and simultaneously has the treating agent removed therefrom.

It is also an object of this invention to provide a method for the treatment of impregnatable yarns with a fluid treating agent moving through a treating zone in which a rotating fibre loop is formed and the loop end portion disposed exteriorly of the treating zone passes through a rotating guide and abruptly changes direction so as to maximize centrifugal forces imparted thereto.

It is another object of this invention to provide a process for treating an impregnatable band with a fluid treating agent in which a plurality of rotating bands are treated simultaneously and twisted together during the treating step. The direction of rotation may also be directed to open the twist in a rotating yarn.

In accordance with the invention, this is achieved in that the fibre band, the yarn or the thread skein is subjected to centrifugal forces after or during the application of the treating agent, which force the agent through the fibre product and partly fling or centrifuge it off simultaneously or subsequently.

In the simplest case, the centrifugal force of the yarn loop which forms on withdrawing the yarn from the spool can be used for this purpose. As the number of revolutions of the withdrawn yarn about the spool increases as the spool diameter decreases, the centrifugal force acting on the yarn at different spool diameters remains substantially constant, particularly if the wall thickness of the spool is selected so as not to be too large. This otherwise very simple method is, however, suitable only for relatively high thread withdrawal velocities, at which correspondingly high centrifugal forces are applied to the withdrawn yarn. In many cases however, it is more advantageous to dispense with the centrifugal force of the yarn loop and to guide the fibre product or yarn through the dye or treating liquor to a rotary plate and by its rotation form a thread loop with a predeterminable centrifugal force and a simultaneous liquor control effect. For more intensive take-up of the liquor, the yarn loop can circulate partly in the liquor and for better use of the rotary plate two or more yarns can pass through it together. In a further embodiment, several yarns or thread skeins, e.g. in the form of a hank, are subjected to centrifugal forces in such a way that their directions of travel are altered abruptly at least once and the treating liquor is thus forced through it at the turns by the centrifugal force acting at them and is then flung off from the yarn.

The liquor flung or centrifuged off can be collected in all cases to a large extent in collecting troughs and can be removed or re-treated in liquor preparation tanks and finally admixed again with the treating liquor.

Further features of the invention are described below in conjunction with the accompanying drawings in which several preferred embodiments of apparatus according to the invention are shown partly in front elevation and partly diagrammatically. The features shown in the drawings can be employed separately or in any desired combination in the various other embodiments of the invention.

IN THE DRAWINGS:

FIG. 3 shows an apparatus for dyeing, improving or washing and subsequently centrifuging fibre bands or yarns by means of a centrifuge plate;

FIG. 4 shows an apparatus for treating individual yarns or fibre hanks in a liquor with subsequent centrifuging caused by abrupt direction changes around guide bars or rollers;

Figure 1:
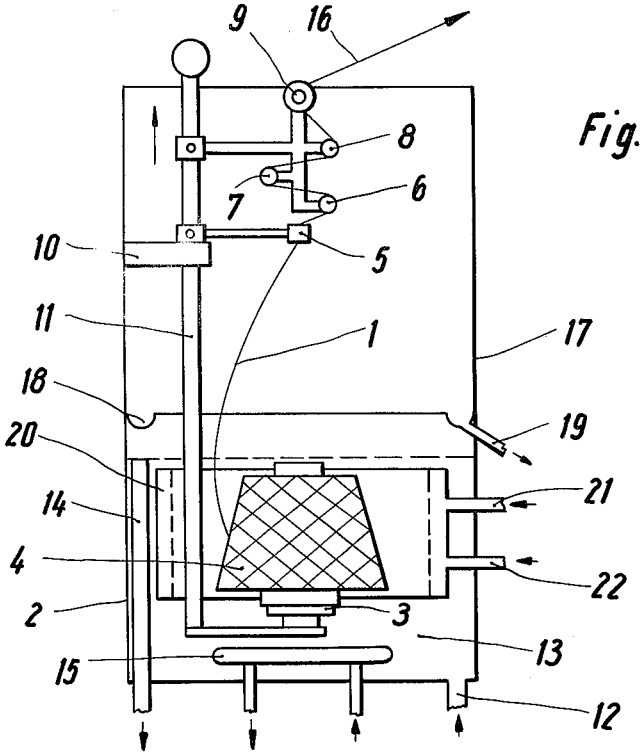
FIG. 1 shows an apparatus for treating cross spools in a liquor and also for centrifuging (hydroextracting) the yarn by the centrifugal force of the thread as it is being withdrawn.

In FIG. 1 an apparatus is shown partly in front elevational view and partly in section for dyeing or treating yarns on spools in a liquor or under the action of liquor spray nozzles with subsequent centrifuging away of the excess dye liquor material by means of the centrifugal force of the yarn loop.

The yarn 1 to be dyed or to be otherwise treated is passed from a spool 4 mounted in a container 2 on a spool mandrel 3 through a loop eye 5 by way of guide rods 6, 7, 8 as well as over a yarn guide roller 9 to a fixing or drying chamber (not shown). The spool mandrel 3, the loop eye 5, the guide rods and the yarn guide roller are secured to a mounting member 11 guided in and supported upon a guide 10.

The treating liquor 13 is supplied through a liquor inlet duct 12 to the container 2 and its amount is regulated by a drainage tube 14 which is adjustable in height. The liquor can be heated to the desired temperature, for instance by means of a heating coil 15, through which steam or another heating medium flows and/or can circulate through a continuous supply of new agent into the bath 2 and thus remain at a uniform composition throughout the whole treating process.

At the beginning of operation, the mounting member 11 is drawn up together with the parts mounted upon it, the spool 4 to be treated is placed on the mandrel and the yarn is withdrawn from the spool through the loop eye 5, over the guide pins 6, 7 and 8 and round the yarn supply roller 9. After returning the mounting member 11 with the spool 4 to the treating liquor 13, withdrawal of the yarn from the spool can begin.

Depending upon the yarn withdrawal velocity and the diameter of the spool, the yarn begins to rotate at 200 to 1,000 rpm about the spool in the treating liquor and is withdrawn from this at, for instance, a velocity of 80 to 400 m/min. Through the high peripheral velocity of the yarn about the spool, centrifugal forces are exerted upon it which lead to the formation of the so-called yarn loop. The section of the yarn in the loop which is located in the bath is thus intensively impregnated. In the longer section of the yarn loop located above the dye liquor, the entrained liquor is forced through the yarn by the centrifugal forces of acting upon it and is then partly centrifuged off from it so that it proceeds for further treatment whilst simultaneously impregnated with the treating liquor.

If however in washing for instance a very intensive centrifuging of the washing agent from the yarn is desired, this can be guided additionally about the guide pin 6, 7 and 8 which can be located in different planes from the axis of the spool. By the abrupt direction changes of the yarn about the guide pins, additional centrifugal forces arise which are not increased by the tension of the yarn around the guide pins but discharge from it the washing liquor remaining in the yarn. The additional yarn tension in the section 16 arising from the direction changing of the yarn as it passes about the guide pins is in most cases desirable. If the yarn tension becomes too high by the yarn being guided about several guide pins, they can be replaced by rollers 9 which undergo rotation by means of the yarn, so that the yarn tension is decreased since the friction of the yarn is reduced. The rotating guide rollers also have the additional advantage that no liquor can be discharged at the guide pins, since this is flung off likewise by the centrifugal force acting at the rotating guide rollers.

The treating liquor centrifuged from the yarn is caught by the wall of the circular container 2 and flows back into the liquor bath 13. Reflux of the centrifuged liquor is thus prevented by the upwardly extended container wall 13 with a drainage trough 18 and outlet pipe 19. The liquor flowing down the container wall 17 thus passes into the outlet or it can be returned to a liquor preparation tank.

In some cases, e.g. when dyeing, it can be a disadvantage that the spool remains immersed in the liquor 13 for long periods, since its end faces in particular remain longer than the other portions of the yarn in contact with the dye liquor. This can be avoided by not locating the liquor in a container, but in a hollow inwardly-perforated liquor spray ring 20 into which the dye liquor is pumped through inlets 21 and 22. The dye liquor sprays from the perforations of the ring 20 on to the surface of the spool and thus on to the yarn rotating round the spool. The advantage of this construction also lies in the relatively large resistance of the liquor to the yarn circulating in the liquor no longer applies and, by timed interruptions of the supply of liquor the yarn can be left undyed and/or can be less intensively dyed as it is withdrawn from the spool, so that a special effect dyeing is obtained. On the other hand, the spray ring can be divided into several chambers with individual dye liquor supply lines, into which differently coloured dye liquors are supplied and the yarn can thus be subjected to multicoloured dyeing.

Figure 2:
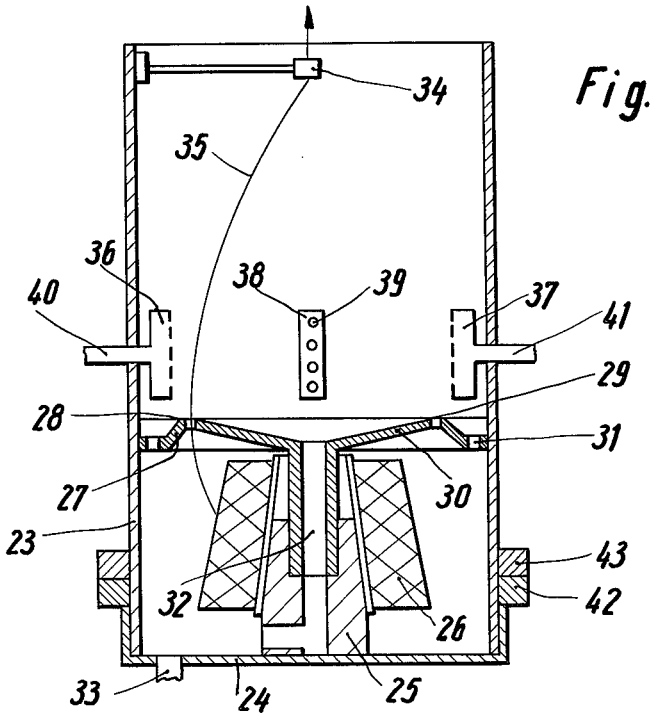
FIG. 2 shows an apparatus for dyeing the thread loop in the lower part and for centrifuging off the excess dye liquor in the upper part of the thread loop.

In FIG. 2, a device is shown in side view partly in section for dyeing the yarn loop with different dyes and centrifuging off the excess dyes.

The apparatus according to FIG. 2 consists of a round tube 23 at the base 24 of which an axially bored spool mandrel 25 with a cross spool 26 is secured. A liquor collecting ring 27 is mounted in the tube 23 and its inner peripheral edge 28 forms an annular slot-like loop guide with the edge 29 of a funnel 30 projecting into the bore of the mandrel. Through openings 31 in the collecting ring 27 and the bore 32 of the funnel, the dye liquor coming from above can pass into the lower part of the tube 23 without thereby moistening the cross spool, and it then flows away through a discharge connection 33.

Above the spool 26, a loop eye 34 is located, to which the yarn 35 is guided from the spool through the narrow gap between the collecting ring 27 and the funnel 30. This arrangement has the advantage that the yarn loop in the section 35 remains at substantially the same size independently of the size of the spool and its distance from the dye applicator devices 36, 37 and 38 is only negligibly altered. The dye applicator devices, which can be arranged mainly round the lower part of the yarn loop, are provided with nozzle openings 39 and supply pipes 40 and 41, through which differently-coloured dye liquor are pumped, under the control of a programming device, alternately and/or intermittently, by means of pumps, into the dye applicator devices, and are sprayed on to the yarn loop 35 from the nozzles 39.

By the centrifugal force acting on the yarn in the upper part of the yarn loop, the excess dye liquor is centrifuged radially through the yarn and then from it to the inner wall of the tube 23, so that intermingling of differently-coloured dye liquors cannot occur, if this is not otherwise intended by operation of the programming device, which can control several devices simultaneously. The mixture of dye liquors centrifuged off is collected and led away at the lower part of the tube 23.

In order to be able to change the spool 26 rapidly, without having to remove, the liquor collecting ring 27 and thread guide 34, the base holder 24 is secured to the tube 23 so as to be readily detachable, for instance by means of annular permanent magnets 42 and 43.

In the devices previously described, the centrifugal force acting on the yarn is determined substantially by the speed of withdrawal of the yarn from the spool. In many cases however, it is necessary to operate with a lower yarn withdrawal speed and to dye, treat, wash and/or very intensively centrifuge the fibre band, hank or yarn to be dyed or treated in can, warp beam, cop, winding, skein forming, yarn cleaning, twisting, doubling or spinning machines.

For these purposes, the apparatus shown diagrammatically in front view in FIG. 3 is especially suitable, in which the dyeing, washing or other treatment as well as the centrifuging of fibre bands or yarns is carried out by means of a centrifuge plate 57.

The fibre band supplied from a can or the yarn 44 withdrawn from a spool is guided, in FIG. 3, over a guide roller 45 between squeezing rollers 46 and 47, the roller 46 of which is driven at the prescribed speed and the roller 47 is pressed on to the roller 46 by a weight 50 and is rotated by it, the roller 47 being located by a pin 48 on a guide rod 49.

The guide rod can be moved upwardly in the guide 51 and held in this position, for instance by means of a catch 52, so that the yarn 44 can be guided outside the liquor 54 located in the tank 53 round the roller 55 and through the yarn loop limiting ring 56 to the centrifuge plate 57, which is stationary at this stage. The roller 55 and the limiting ring 56 are adjustably mounted on the guide rod 49 by means of a mounting arrangement 58, whereby the guide roller and the limiting ring can be moved on the mounting so that these parts can be located either in or above the liquor 54 during the centrifuging process.

The centrifuge plate 57 provided with one or more yarn eyelets 59 and 60 at various distances from its centre is secured to a hollow shaft 62 provided with a yarn guide opening 61, which shaft is rotatably mounted in a bearing 63 and is driven via a belt wheel 64 and a driving belt 65 from a driving pulley 66 having an adjustable velocity.

The yarn coming from the guide roller 55 is led in the direction of the arrow through one of the yarn eyelets 59 or 60, the yarn guide opening 61 and the hollow shaft 62 to a yarn take-up device (not shown), for example a fixing or drying chamber. After passage of the yarn through the various devices described, the guide rod 49 is freed from the catch 52, the yarn is immersed in the liquor and the air contained between the fibres is expressed by the squeezing rollers 46 and 47, so that the liquor can penetrate well into the fibre band or the yarn. The centrifuge plate 57 is made to rotate at the same time and begins to rotate the section of yarn between the roller 55 and the yarn eyelet 60 at the prescribed number of revolutions, so that the yarn loop 67 is formed by reason of the centrifugal force. Also, the centrifuge plate 57 produces a false lay or twist in the same direction of yarn, the size of which is determined by the yarn advance speed and the number of revolutions of the centrifuge plate, whereby several factors which have still to be described act satisfactorily upon the treatment and/or upon the centrifuging of the yarn.

The liquor centrifuged off is collected by a tube 69 secured to the container 53 and provided with an outlet channel 68 and is led off from the channel through a pipe 70. For access to the centrifuge plate 57, e.g. on threading the yarn through, a flap or door 71 is provided in the tube 69. In the lower part of the tube 69, as described in relation to FIG. 1 or FIG. 2, additional liquor spray rings or several dyeing and treating liquor spray devices can be provided, from which, as regulated by control devices, various dye liquors and/or treating agents can be sprayed on to the yarn as desired.

The apparatus of FIG. 3 can also consist however only of the rotary plate 57, the tube 69 with the liquor collecting channel 68, the corresponding liquor spray devices and a loop eyelet or twist stop device, whereby the yarn supply and the yarn removal are determined by supply rollers or by the preceding and succeeding devices.

Operation with the false twist device in the form of a centrifuge plate 57 according to FIG. 3 has several advantages. It is possible with this device considerably to compact or solidify untwisted or only lightly twisted fibre bands, by the false twisting, and to establish high centrifugal forces. The twisting effect can be stopped at this position by a single wrapping of the fibre band or the yarn round the roller 55, so that the fibre band or yarn runs through the treating agent or liquor only lightly twisted. Naturally, it is also possible to stop the twisting only at the squeezing rollers. Highly twisted yarns or doublings can be rotated in contrast to the twisting or doubling direction by the centrifuge plate 57 and thus can pass in a loosely twisted stage through the treating liquor or agent, so that this can be impregnated more rapidly into the yarn or into the doubling. If the guide roller 55 and/or the loop limiting ring 56 is immersed in the treating liquor, the yarn is additionally intensively impregnated by the liquor by reason of the rapid speed of rotation in it. If the fibre band, yarn or doubling has to be very intensively dried, e.g. after washing, operation can proceed with a higher degree of twist, so that a considerably higher false twisting of the yarn occurs at the increase centrifugal force, which forces the excess liquor from the yarn, so that in many cases a further drying of the yarn is rendered unnecessary.

When dyeing highly shrinking yarns or doublings, such as high bulk acrylic or polyester yarns or their mixtures with wool, levelling or flattening of the yarn or doubling often occurs, which can be avoided with the device according to FIG. 3, by opening out the dyed yarn to a greater or lesser extent, by rotation of the centrifuge plate 57 contrary to the yarn laying or doubling direction and, at the same time, the yarn is subjected to steam or warm air treatment and is then shrunk, opened out, shaped and thus becomes very voluminous with a corresponding lower tension in the yarn or doubling.

Synthetic and particularly textured yarns are often contaminated with damaging amounts of monomers or oligomers. If a device according to FIG. 1 or FIG. 3 is interposed in the winding process between the dyed skein, doubling or winding package and the winding position, the monomers or oligomers can be washed out during the winding process and the yarn can simultaneously be centrifuged so as to be dry ready for winding.

If the structure of the yarn or doulbing must not be affected in any way during the treatment and the centrifuging process, e.g. with special effect yarns or doublings, two or more yarns must be led simultaneously through the centrifuge plate 57, so that these are largely doubled separately and the yarn structure or the doubling composition cannot be adversely affected. This also has the advantage that, with equivalent action of the device, several yarns or doublings can be treated together, which can subsequently be wound separately.

In FIG. 4, a device for treating and centrifuging away the liquor by centrifugal forces from yarn skeins is illustrated diagrammatically in side view.

The skein 72 to be treated is withdrawn from a skein former or a warp beam 73, by means of driven withdrawal and squeezing rollers 75 and 76 which are partially located in the dye or treating liquor 74. The rollers 75 and 76 simultaneously free the yarn from included air, so that the liquor 74 can rapidly penetrate the yarn. In the liquor container 77, rotatably-mounted and, if required, driven guide rollers 78 are provided, round which the skein is guided and is abruptly diverted several times from its original direction of movement into a new direction of travel.

By the multiple abrupt direction changes of the skein as it is guided through the liquor at high speed, high centrifugal forces are imparted repeatedly to its individual yarns, so that the treating agent or liquor present in the yarn is forced out from them and replaced by fresh liquor material, which results in an intensive passage of the dye or treating liquor through the yarn. At the point where the skein 72 leaves the liquor containers 77, a part of the excess liquor is expressed by the likewise driven squeezing rollers 79 and 80 and it flows from the skein back into the container 77. The skein treating section in the liquor container is followed by a skein centrifuging section, which consists essentially of several lightly mounted and, if required, driven guide rollers 81 over which the skein is guided, as shown in FIG. 4. By the repeated abrupt direction changes of the yarn skein as it is guided at high speed round the guide rollers, the liquor remaining in the yarn is subjected to such high centrifugal forces that it is flung off at the positions of change of direction and is collected by a container 82 as well as by a curved cover 83 provided with liquor collecting channels 84 and can flow back through outlet pipes 85, 86. Finally, the yarn skein 72 is passed from outlet pull rollers 87 and 88 to a fixing or drying chamber, not shown, or to a further treating tank.

The advantage of the apparatus described in relation to FIG. 4 is that if the guide rollers 78 and 81 are driven, the squeeze rollers 75, 76 and 79, 80 pressed against one another and also the pull rollers 87 and 88, which closely limit the throughput velocity of the yarn skein, become unnecessary and the treated band or skein can be guided through the device with a higher velocity, for the same treating and drying effect.

In all the cases described, the treating agent can be applied to or sprayed on, not only as dyeing, treating, washing or winding liquor but also as adhesives and/or solid pulverulent materials, gases, air, steam and/or water-steam mixtures in the cold or warm state to the fibre band, ribbon, tape, hank, yarn, skein or the like. It is naturally also possible to form two or more similar or different ones of the described devices one after the other, into a continuous treating plant.

It has proved particularly advantageous to apply the treating liquors or agents at those parts of the yarn sections under centrifugal force at which the centrifugal force is at its smallest and to carry out the subsequent centrifuging at the places having the greatest centrifugal force.

The centrifugal force of the devices described in relation to FIGS. 1 and 2 can be further increased by mounting the spools on rapidly rotating spindles instead of on mandrels, whereby on the one hand the centrifugal force acting on the yarn section located between the spool and the loop eyelet is increased and on the other hand the treatment of the yarn can be coupled with its twisting or doubling.

Within the scope of the present invention, many advantageous modifications and improvements are possible, particularly in relation to the centrifuge plate described in relation to FIG. 3.

Figure 5:
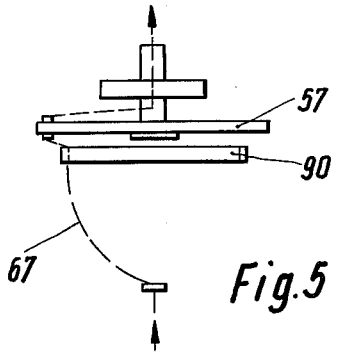
FIGS. 5 and 6 show a rotating centrifuge plate with a preceding or succeeding yarn friction ring; and, FIG. 7 shows a preferred treating apparatus with rotating centrifuge plate and a riser pipe for the simultaneous passage of the treating agent through the yarn product to be treated and of the cyclically supplied treating liquor.

It has been found, in the operation of the device according to FIG. 3, that by the action of large centrifugal forces on the yarn, its projecting fibre ends are centrifuged free from the dye and/or treating liquor so strongly that they are wetted by the treating liquor less than the core of the yarn, which forms a so-called grey film or fog, particularly with dark dyes, which can be notably disadvantageous. This can be avoided, according to FIG. 5, by subjecting the yarn 67 to be treated, directly before it leaves the region of the centrifugal force of the yarn loop, to a further centrifugal force at a stationary ring 90 of metal, plastics material or ceramic material surrounding and lightly constraining the yarn loop, so that the liquor remaining in the yarn is simultaneously distributed to the yarn core and the fibre ends projecting from the yarn by contact of the ends with the yarn core and the friction upon the ring 90.

Figure 6:
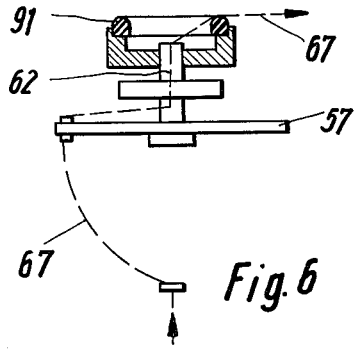

A more intensive distribution of the liquor between the yarn core and the projecting fibre ends results if, according to FIG. 6, after passing out from the bore of the centrifuge plate shaft 62 the yarn 67 is passed over the edge of a friction ring 91 secured to the shaft 62, in the direction of the arrow. With this arrangement, the yarn 67 rolls upon the friction ring 91, which is advantageously made of rubber or a similar material, so that depending upon the diameter of the friction ring 91 and the yarn tension the liquor remaining in the yarn core is wrung out to the yarn surface and thus moistens the projecting fibre ends.

Figure 7:
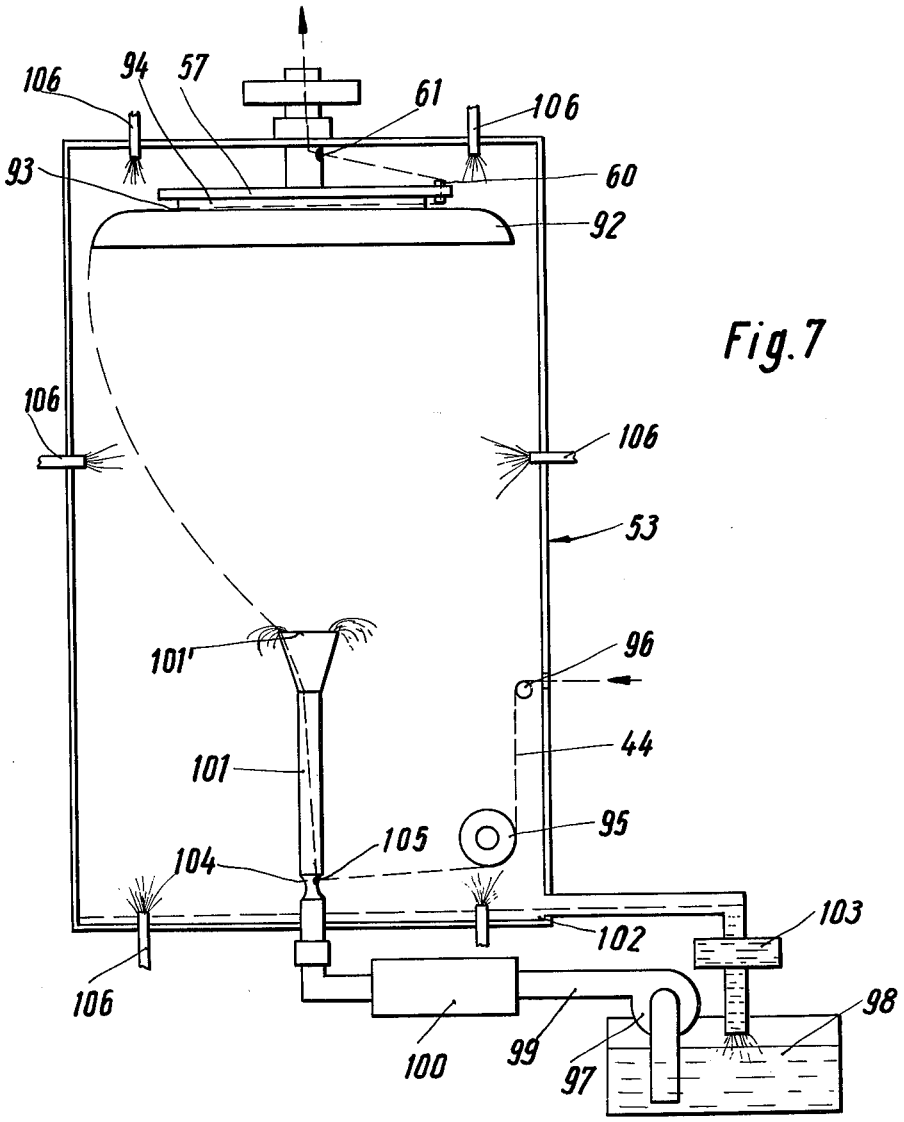

Since the amounts of liquor remaining in the yarn are also determined by the loop diameter and this varies according to the yarn tension, it is advantageous to provide the centrifuge plate 57 according to FIG. 7 with a yarn storage plate 92. This is of hood-like shape and is secured above a neck-like projection 94 forming a thread guide groove 93 at the underside of the centrifuge plate 57. At a normal yarn tension, the section of yarn between the eyelet 60 and the inlet opening 61 lies approximately upon half the circumference in the groove 93 of the storage plate 92. As soon as the yarn tension varies, the section of yarn in the groove 93 shortens or lengthens, so that the diameter of the yarn loop remains constant even with tension variations. At the same time by reason of the air resistance, the yarn in this embodiment is drawn obliquely over the surface of the storage plate 92, which thus acts similarly to the ring 91 already described in avoiding a grey film or fog effect.

As also shown in FIG. 7, the squeezing rollers 46 and 47 in the embodiment according to FIG. 3 can be replaced by simple guide rollers 95 or guide pins 96. The oncoming yarn 44 is thus guided one or more times round the guide rollers or pins. The guide rollers or pins can alternatively be so secured on or connected to the door 71 (see FIG. 3) that, on opening the door, the rollers and/or the pins are raised so as better to thread the yarn out from the treating liquor 54.

The construction according to FIG. 7 has also proved to be very advantageous as regards the supply of the liquor and yarn. The liquor is pumped from the collecting container 98 into the container 53, by means of a pump 97, passing through a duct 99 and a valve 100 to a riser pipe 101. The excess liquor material overflows at the upper end of the riser pipe 101, which is advantageously widened out in funnel fashion, and passes into the container 53 from which it flows via an outlet 102 through a filter 103 back to the collecting container 98.

For better threading of the yarn 44 into the riser tube 101, the latter is provided with a venturi nozzle 104 through the opening 105 of which the yarn 44 passes into the riser tube 101, which functions simultaneously at its funnel-like widened end 101' as a loop-forming eyelet. Obviously, several operative stations of a machine can be supplied with dye or treatment liquor from a single liquor container 98 and a pump 97, so that it can become necessary in many cases to heat the liquor before its entry into the riser tube 101. In addition, the enclosure in which the centrifuge plate is located can be heated, for instance by incoming steam or from outside by means of heating agents.

Since with such apparatus the dye of the dye liquor is often changed or the composition of the treating agent modified and manual washing out would take much too much time, in all the containers 53 and/or enclosures, spray nozzles 106 are provided through which the devices can be washed for instance with hot water.

Finally, it has been found, particularly in treating thicker yarns, hanks, skeins, tapes, fibre bands or strips, that the expressing (wringing out) of excess treating liquor by the action of the false loop formed between the false twist former and the liquor applicator device proceeds to a relatively large extent. In this case, the centrifugal forces which act on the material to be treated only play a subordinate roll. The projecting fibre ends are then sufficiently wetted by the treating liquor.

I claim:

1. In a method for treating a fluid-impregnatable textile fibre band with a fluid treating agent, the steps comprising contacting such fibre band with such treating agent while moving through a zone containing such treating agent; forming the treated fibre band material into a loop by rotating a length of such treated fibre band material about an axis of rotation extending from such treating agent zone so as to subject such loop to centrifugal forces; one end portion of said loop being disposed in said treating agent zone during rotation thereof, whereby said one end portion is intensively impregnated with said treating agent; the portion of said loop subjected to the greatest centrifugal forces being disposed exteriorly of said treating agent zone after passing through said zone, whereby said treating agent is readily removed from said latter loop portion by centrifugal forces, and guiding the end portion of the loop disposed exteriorly of said treating agent along said axis of rotation whereat said band is withdrawn away from said treatment zone.

2. In a method for treating a fluid-impregnatable fibre band with a fluid treating agent, the steps comprising contacting such fibre material band with such treating agent while moving through a zone containing such treating agent; forming the treated fibre band material into a loop by rotating a length of such treated fibre band material about an axis of rotation extending from such treating agent zone so as to subject such loop to centrifugal forces; one end portion of said loop being disposed in said treating agent zone during rotation thereof, whereby said one end portion is intensively impregnated with said treating agent; passing the end portion of said loop disposed exteriorly of said treating zone through a rotating guide means opening spaced from and rotating about the axis of loop rotation; said textile fibre band abruptly changing direction after passing through said guide means and then passing through said axis of rotation.

3. The method of claim 1 in which the fibre band is compressed to remove air therefrom whereafter it is allowed to decompress while immersed in the treating agent so that said agent may better penetrate said band.

4. The method of claim 1 in which said treating agent is a member of the class consisting of liquid, powder, gas, air steam and a steam-water mixture.

5. The method of claim 1 in which a plurality of bands are simultaneously treated by the formation of rotating loops of substantially uniform centrifugal force which are wound up together after treatment on a winding device.

6. The method of claim 1 in which the fibre band comprises a yarn which is revolved in a direction of revolution when subjected to centrifugal forces so as to open the twist therein.

7. The method of claim 1 in which said textile fibre band rotates about a substantially vertical axis of rotation and a lower portion of said loop is disposed in said treating zone at a generally acute angle relative to said axis of rotation.

8. The method of claim 1 in which said treating agent comprises a plurality of different dyes which engage said textile fibre material.

9. The method of claim 2 in which said guide means comprises an apertured plate and a plurality of textile fibre bands simultaneously pass through a plurality of spaced openings in said plate and form loops rotating about said axis of rotation; said plate rotation simultaneously imparting a twist to said bands as a result of said rotational movement, and in combination with the step subsequently winding the commonly treated bands after passing through said plate.

10. The method of claim 2 in which said rotating guide means comprises an apertured rotating plate; said textile fibre band abruptly changes direction after passing through said plate and is in combination with the step of drawing said band away from said plate along said axis of rotation.

* * * * *